United States Patent [19]

Ishizaki

[11] 4,084,295

[45] Apr. 18, 1978

[54] BUTTON

[76] Inventor: Hidenosuke Ishizaki, 6-13, 6-chome, Kobe-shi, Japan

[21] Appl. No.: 811,317

[22] Filed: Jun. 29, 1977

[51] Int. Cl.[2] ..... A44B 1/42

[52] U.S. Cl. ..... 24/95

[58] Field of Search ..... 24/95

[56] References Cited

U.S. PATENT DOCUMENTS 459,483 9/1891 White ..... 24/95

FOREIGN PATENT DOCUMENTS 12,222 of 1890 United Kingdom ..... 24/95

*Primary Examiner*—Bernard A. Gelak

*Attorney, Agent, or Firm*—Larson, Taylor and Hinds

[57] ABSTRACT

A button comprises a button face member; a support plate having a center hole for supporting the face member; a hollow button shank having upper and lower open ends, a constricted neck at its upper portion and a shoulder extending downward from the constricted neck, the neck having a smaller diameter than the center hole, the shoulder having a larger diameter than the center hole; a bending guide member disposed within the shank and having a slanting surface at its bottom for bending and guiding; an engaging member having a center bore extending therethrough and disposed within the shank and under the bending guide member; and a fastening member having a piercing needle. The support plate is loosely fitted around the neck of the shank and retained thereon by an enlarged top portion formed at the upper end of the neck after the support plate has been loosely fitted around the neck. The button face member is fitted over the support plate to form a button head from the face member and the support plate, whereby the button head is pivotably turnably supported by the shank with the enlarged top portion of the shank positioned within the space defined by the face member and the support plate. The button main body is fastened to a fabric or like sheet-like material by the piercing needle of the fastening member.

5 Claims, 13 Drawing Figures

BUTTON

The present invention relates to buttons, and more particularly to improvements in buttons which comprise a button shank and a button head pivotally turnably mounted on the upper end of the button shank and which are convenient to use, such that the button main body can be easily and efficiently attached to a fabric without resorting to sewing.

Generally, buttons are so designed that the button head is sewn to a fabric as positioned close thereto. Thus it is difficult to smoothly pass the button through a button-hole. This difficulty increases in the case where the button-hole is formed in a thick fabric such as an overcoat fabric or in a hard fabric as in jeans.

To overcome the above-mentioned drawback, various buttons have been provided which include an elongated button shank and which can be passed through the buttonhole with greater ease. With most of the buttons of this type, however, the button head is secured to the shank and is not pivotable or turnable independently of the shank. Thus they still involve difficulty in being passed through the buttonhole as smoothly as is desired.

Furthermore, because buttons are usually sewn to a fabric, they are cumbersome to secure to the fabric and are liable to come off the place when the sewing thread is worn away or inadvertently cut.

In recent years, buttons of another type have been developed which include an elongated shank formed with a threaded bore and a fastening member provided with a threaded stem so that the button can be attached to a fabric by screwing the fastening member into the threaded bore without resorting to sewing. The buttons of this type are therefore convenient to secure to the fabric but still have the drawback that the button tends to come off when the fastening member loosens.

The main object of this invention is to provide a button comprising a button head which is pivotably turnably mounted on a slightly elongated button shank and which can be passed through a buttonhole smoothly and easily because it is freely pivotable and turnable, even when the buttonhole is formed in a thick or hard fabric.

Another object of this invention is to provide a button which can be easily secured to a fabric without resorting to sewing in any way or to screw-thread engagement and which, when secured to a fabric, can be held in place with much greater strength than various known buttons free of any possibility of coming off during use.

The button of this invention comprises a button face member; a support plate having a center hole for supporting the face member; a hollow button shank having upper and lower open ends, a constricted neck at its upper portion and a shoulder extending downward from the constricted neck, the neck having a smaller diameter than the center hole, the shoulder having a larger diameter than the center hole; a bending guide member disposed within the shank and having a slanting surface at its bottom for bending and guiding; an engaging member having a center bore extending therethrough and disposed within the shank and under the bending guide member; and a fastening member having a piercing needle. The support plate is loosely fitted around the neck of the shank and retained thereon by an enlarged top portion formed at the upper end of the neck after the support plate has been loosely fitted around the neck. The button face member is fitted over the support plate to form a button head from the face member and the support plate, whereby the button head is pivotably turnably supported by the shank with the enlarged top portion of the shank positioned within the space defined by the face member and the support plate. The button main body is fastened to a fabric or like sheet-like material by the piercing needle of the fastening member.

With the button of this invention having the foregoing structure, the button head composed of a face member and a support plate loosely fitting around the constricted neck of the button shank is smoothly pivotable and turnable, because the enlarged top portion of the button shank is positioned within the space defined by the face member and the support plate. Accordingly, the button can be smoothly and easily passed through a buttonhole even if the buttonhole is formed in a thick fabric as in an overcoat or in a hard fabric as in jeans, with the result that the garment can be put on or taken off easily and quickly, with a reduced possibility of damaging the portion of the fabric defining the buttonhole.

The button of this invention has another advantage that it can be secured to the fabric very easily and firmly without resorting to sewing in any way but merely by placing the button shank on the front surface of the fabric with the bottom of the engaging member therein in contact with the fabric, inserting the piercing needle of the fastening member into the bore of the engaging member from the rear surface of the fabric and forcing the needle into the shank. Stated more specifically, the end of the piercing needle inserted into the bore of the engaging member is forced against the slanting surface of the bending guide member housed in the shank, whereby the needle is bent and guided sidewise along the slanting surface. Consequently, the needle is immovably engaged by the slanting surface of the guide member and by the upper edge of the engaging member defining the bore. Unlike the case in which buttons are attached to the fabric by sewing or screw-thread engagement, the button of this invention can be secured in place with extreme ease free of any possibility of coming off.

This invention will be described below in greater detail with reference to the accompanying drawings, in which.

Figure 1:
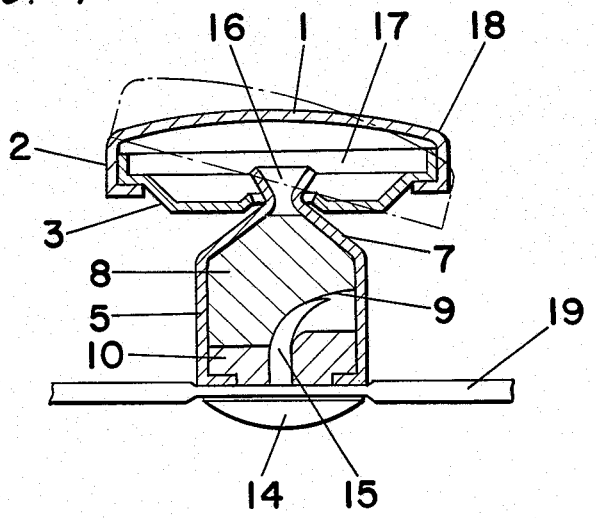
FIG. 1 is a view partly in section showing a button of this invention assembled from the components shown in FIGS. 2 to 12 and secured to a fabric.
Figure 2:
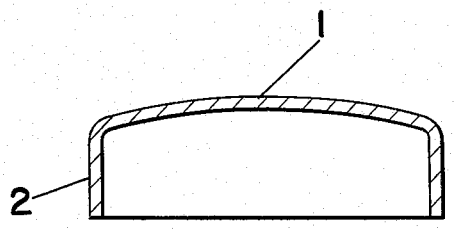
FIG. 2 is a view in vertical section showing a button face member.
Figure 4:
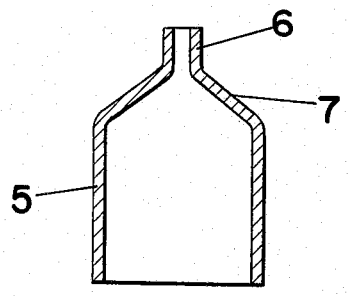
FIG. 4 is a view in vertical section showing a button shank.

With reference to FIGS. 1 to 12, the button of this invention comprises a button face member 1, a support plate 3 for the button face member, a button shank 5, a bending guide member 8, an engaging member 10 and a fastening member 14.

The button face member 1 is in the form of chrome-plated metal plate having a circular shape in plan view and including a peripheral wall 2 to be crimped. (see FIGS. 2 and 8).

Figure 3:
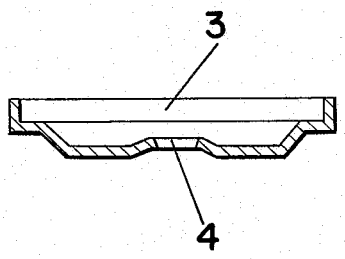
FIG. 3 is a view in vertical section showing a support plate for the button face member.
Figure 5:
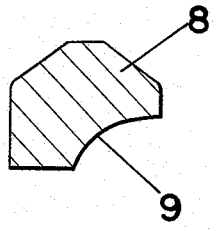
FIG. 5 is a view in vertical section showing a bending guide member.
Figure 9:
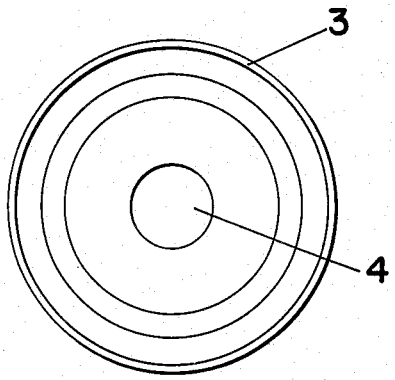
FIG.9 is a plan view showing the support plate for the button face member.
Figure 10:
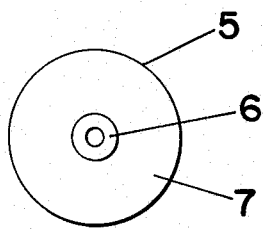
FIG. 10 is a plan view showing the button shank.
Figure 11:
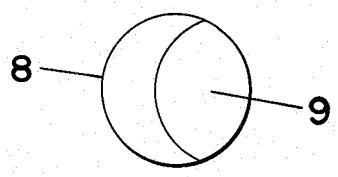
FIG. 11 is a bottom view of the bending guide member.

The support plate 3 for the button face member is in the form of a metal plate circular in plan view and having a center hole 4. As seen in FIGS. 3 and 9, the support plate 3 has a peripheral portion which is positioned at a slightly higher level than its center portion.

The button shank 5 is a hollow member having upper and lower open ends and made from a metal sheet by press work. The button shank 5 has at its upper portion a constricted neck 6 having a predetermined length and a smaller diameter than the center hole 4. A shoulder portion 7 extending downward from the constricted neck 6 has a larger diameter than the center hole 4 (see FIGS. 1, 4 and 10).

The bending guide member 8 included in the embodiment of FIG. 1 is a short cylindrical member having an upper half portion in the form of a truncated cone fitting to the inner wall surface of the shoulder 7 of the button shank 5. The bending guide member 8 is formed over more than onehalf of its bottom with an inwardly curved slanting surface 9 slanting upward from the bottom surface for bending and guiding the fastening member 14 (see FIGS. 5 and 11). The bending guide member 8 is usually made of hard material such as metal, rigid plastic, glass or pottery.

Figure 6:
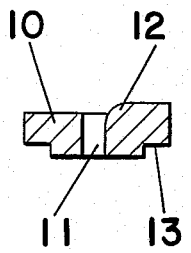
FIG. 6 is a view in vertical section showing an engaging member.
Figure 8:
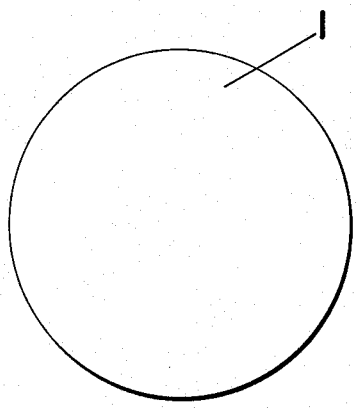
FIG. 8 is a plan view showing the button face member.
Figure 12:
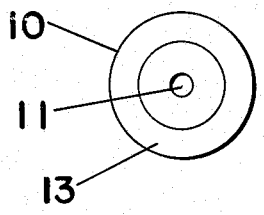
FIG. 12 is a bottom view showing the engaging member.

As shown in FIGS. 6 and 12, the engaging member 10 included in the embodiment of FIG. 1 is a thick disk having a center bore 11 extending therethrough. On one side of the bore 11, the engaging member 10 has a thick portion 12 having a slightly greater thickness than the other portion. The engaging member 10 further has a slightly recessed peripheral surface 13 on its bottom. The engaging member 10 is made of the same material as the bending guide member 8.

Figure 7:
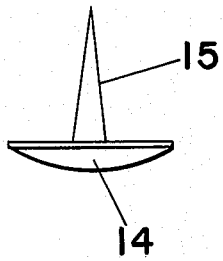
FIG. 7 is a front view showing a fastening member.

The fastening member 14 comprises a fastening disk and a piercing needle 15 projecting from the center of the disk. The needle 15 is made of a metal material which is not easily bendable but can be bent by a considerably great force (FIG. 7).

The parts described above will be assembled into the button, for example, in the following manner.

The constricted neck 6 of the button shank 5 is inserted into the center hole of the support plate 3 to loosely fit the support plate 3 around the neck 6. The open upper end of the neck 6 is then enlarged radially outward thereof to form an enlarged top portion 16, which prevents the support plate 3 from dropping off.

The button face member 1 is fitted over the support plate 3, and the peripheral wall 2 of the member 1 is crimped inward over the plate 3, whereby the button face member 1 is held to the support plate 3 to provide a button head 18 having an interior space 17. With the enlarged top portion of the button shank 5 thus positioned within the space 17, the button head 18 is pivotably turnably retained on the button shank 5.

The bending guide member 8 is placed into the button shank 5, and then the engaging member 10 thereinto. The lower end of the shank 5 is thereafter crimped to fold the end over the peripheral recessed surface 13 on the bottom of the engaging member 10. The members 8 and 10 are therefore enclosed in the button shank 5. When the engaging member 10 is placed into the shank 5, it is preferable to position the thick portion 12 under the slanting surface 9 of the bending guide member 8.

The button main body thus assembled is attached to a fabric 19 or like sheet material by the fastening member 14 in the mode illustrated in FIG. 1. The bottom of the engaging member 11 enclosed in the button shank 5 is placed on the front surface of the fabric 19, and the piercing needle 15 of the fastening member 14 is inserted into the bore 11 in the engaging member 10 from the rear surface of the fabric and forced into the button shank 5. The end of the needle 15 is thereby forced against the slanting surface 9 of the bending guide member 8 housed in the button shank 5, whereby the needle is bent and guided sidewise along the slanting surface 9. Consequently, the needle is immovably engaged by the slanting surface 9 and by the upper edge of the engaging member 10 defining the bore 11. In this way, the button can be attached to the fabric effectively.

Figure 13:
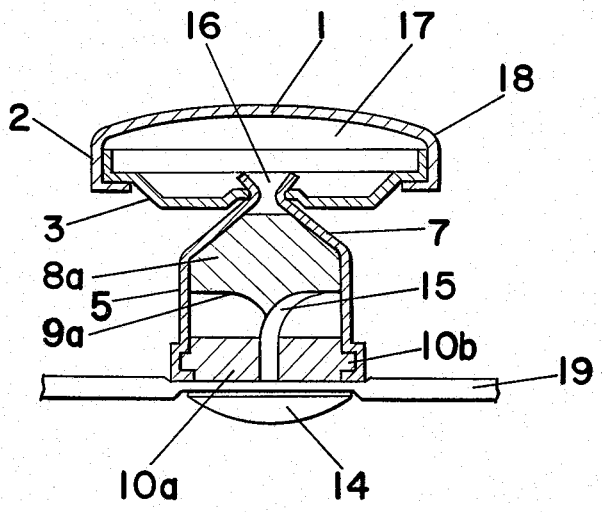
FIG. 13 is a view partly in vertical section showing another button embodying this invention and secured to a fabric.

FIG. 13 shows another embodiment of this invention as attached to a fabric. This embodiment has the same construction as the embodiment already described, with the exception of the bending guide member and engaging member. The bending guide member 8*a* of this embodiment has a slanting surface 9*a* extending from the center of its bottom radially outwardly upward in a slanting fashion over the entire bottom area. The engaging member 10*a* is in the form of a thick disk having a uniform thickness therethrough and has a projection 10*b* extending over its peripheral side surface. The lower end of the button shank 5 is folded and crimped over the projection 10*b* to retain the engaging member 10*a* within the button shank 5. With this embodiment, the bending guide member 8*a* placed into the shank 5 must be adhered to the shank with an adhesive.

Although principal embodiments of this invention have been described above, they are given for illustrative purposes only and are not in any way limitative.

For example, the slanting surface of the bending guide member, one component of the button of this invention, may be shaped variously insofar as the end of the piercing needle of the fastening member can be bent and guided sidewise by the surface when forced thereagainst. Furthermore, instead of forming the enlarged top portion on the constricted neck of the button shank, a plug or like enlarged member may be provided at the open upper end of the neck.

Other changes and modifications of this invention may be made by those skilled in the art without departing from the scope of the invention as defined in the appended claims.

What is claimed is:

1. A button comprising:

a button face member, a support plate having a center hole for supporting the face member, a hollow button shank having upper and lower open ends, a constricted neck at its upper portion and a shoulder extending downward from the constricted neck, the neck having a smaller diameter than the center hole, the shoulder having a larger diameter than the center hole, a bending guide member disposed within the shank and having a slanting surface at its bottom for bending and guiding, an engaging member having a center bore extending therethrough and disposed within the shank and under the bending guide member, and a fastening member having a piercing needle, the support plate being loosely fitted around the neck of the shank and retained thereon by an enlarged top portion formed at the upper end of the neck after the support plate has been loosely fitted around the neck, the button face member being fitted over the support plate to form a button head from the face member and the support plate, the button head being pivotably turnably supported by the shank with the enlarged top portion of the shank positioned within the space defined by the face member and the support plate, the shank being fastenable to a fabric or like sheet-like material by the piercing needle of the fastening member.

2. A button as defined in claim 1 wherein the slanting surface of the bending guide member slants upward from its bottom surface.

3. A button as defined in claim 1 wherein the bending guide member is adhered to the inside surface of the button shank.

4. A button as defined in claim 1 wherein the enlarged top portion of the shank is formed by enlarging the open upper end of the neck radially outwardly thereof.

5. A button as defined in claim 1 wherein the enlarged top portion of the shank is formed by providing an enlarged member at the open upper end of the neck.

* * * * *